US006928259B2

(12) United States Patent
Sakuma

(10) Patent No.: US 6,928,259 B2
(45) Date of Patent: Aug. 9, 2005

(54) FINISHING APPARATUS

(75) Inventor: Akira Sakuma, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/372,850

(22) Filed: Feb. 26, 2003

(65) Prior Publication Data

US 2004/0042812 A1 Mar. 4, 2004

(30) Foreign Application Priority Data

Aug. 30, 2002 (JP) ..... P2002-253471

(51) Int. Cl.[7] ..... G03G 15/00
(52) U.S. Cl. ..... 399/407; 399/410
(58) Field of Search ..... 399/407, 408, 399/410, 82; 270/58.08, 58.09

(56) References Cited

U.S. PATENT DOCUMENTS 4,628,578 A * 12/1986 Yajima
5,535,655 A * 7/1996 Kammann
6,027,107 A * 2/2000 Natsume et al. ..... 399/410
6,430,382 B1 * 8/2002 Okamoto et al. ..... 399/82
6,549,734 B2 * 4/2003 Yamada et al. ..... 399/407

FOREIGN PATENT DOCUMENTS

JP 04056458 A * 2/1992 ..... H04N/1/00
JP 9-249348 9/1997
JP 11292388 A * 10/1999 ..... B65H/37/04
JP 2000086072 A * 3/2000 ..... G03G/21/00

* cited by examiner

*Primary Examiner*—Susan Lee
(74) *Attorney, Agent, or Firm*—Morgan, Lewis & Bockius LLP

(57) ABSTRACT

A finishing apparatus 4 has an image forming apparatus 1 for forming an image by an image formation module and a finisher 3 for finishing for a record sheet 2 on which an image is already formed from the image forming apparatus 1. The finisher 3 has a punching unit 5 for punching a hole in the record sheet 2. The finishing apparatus 4 further includes mark recorder 6 for recording a mark M to determine the punch position on the record sheet 2 before punching.

14 Claims, 7 Drawing Sheets

FINISHING APPARATUS

BACKGROUND OF THE INVENTION

This invention relates to a finishing apparatus including an image forming apparatus such as a copier, a printer, or a facsimile using electrophotography and a finisher for finishing for a record sheet on which an image is already formed from the image forming apparatus and in particular to an improvement in a finisher for performing predetermined punching or stapling for each record sheet.

Hitherto, as this kind of finishing apparatus for performing punching, an apparatus including a punch mechanism (puncher) which previously moves to a predetermined position based on size information of a sheet-like member (record sheet) in a width direction there of and punching information indicating whether or not punching is to be performed wherein the puncher stands by at the position corresponding to a sheet-like member of the maximum width to which punching can be applied when punching is not performed has been proposed, for example, as disclosed in the Unexamined Japanese Patent Application Publication No. Hei 9-249348.

In such a form, an apparatus including a plurality of sheet width direction end face detector placed for performing punching corresponding to a plurality of sheet sizes wherein the sheet width direction end face detector to be used is selected in response to the size information of each record sheet in a width direction thereof for sensing the width direction end face of the record sheet and a move of a puncher is stopped based on the detection information for performing punching under the condition determined for each record sheet is proposed.

In such a form, however, a plurality of detector need to be provided and therefore in addition to an increase in the cost, it becomes difficult to deal with different types of record sheets having close sheet sizes, and it is difficult on design to place a plurality of detector corresponding to the types of record sheets.

A form is also proposed wherein only one sheet width direction end face detector is placed and the time interval between the instant at which the sheet width direction end face detector detects the width direction end face of a record sheet and the instant at which move unit of a puncher is stopped is determined in response to the width direction size information of the record sheet and punching is performed under the condition determined for each record sheet.

According to the form, only one detector is needed and therefore the above-mentioned problem of an increase in the cost is eliminated, but it is necessary to reciprocate the puncher for each record sheet so as to match the size of the record sheet, and a technical problem of incompatibility with a high-speed machine and incapability of realizing high productivity occurs.

Particularly, this technical problem becomes more noticeable as the record sheet size is smaller.

FIGS. 8A and 8B show a comparison between the puncher move distance when the record sheet size is large and that when the record sheet size is small.

As shown in FIG. 8A, if the size of a record sheet S is large, the time interval between the instant at which sheet width direction end face detector 310 detects the width direction end face of the record sheet S and the instant at which move unit of a puncher 300 is stopped is determined and the puncher 300 is moved in the arrow direction in the figure (to the right) for punching at a predetermined position.

At this time, the move distance of the puncher 300 is represented by distance $I_1$ between puncher center A and record sheet center B.

On the other hand, as shown in FIG. 8B, if the size of the record sheet S is small, punching is performed as the size of the record sheet S is large, but the move distance of the puncher 300 is represented by distance $I_2$ and if a comparison is made between $I_1$ and $I_2$, $I_2$ is fairly large as compared with $I_1$, namely, when the size of the record sheet S is small, the puncher 300 must be moved largely.

SUMMARY OF THE INVENTION

It is therefore an object of the invention to provide a finishing apparatus including a finisher for making it possible to easily and rapidly finish for record sheets different in sheet size.

To the end, according to the invention, there is provided a finishing apparatus 4 including an image forming apparatus 1 for forming an image by an image formation module and a finisher 3 for finishing for a record sheet 2 on which an image is already formed from the image forming apparatus 1, characterized in that the finisher 3 has a punching unit 5 for punching a hole in the record sheet 2, characterized by mark recorder 6 for recording a mark M to determine the punch position on the record sheet 2 before punching, as shown in FIGS. 1A and 1B.

In such technical means, the record sheet 2 includes not only generally used paper, but also special image forming apparatus such as an OHP sheet.

The finisher 3 may be integral with the image forming apparatus 1 such as a copier or a printer or may be a separate body that can be attached to and detached from the image forming apparatus 1.

Further, in the example, the finisher 3 includes the punching unit 5 for punching a hole in the record sheet 2, but maybe changed in design appropriately so as to include a stapling unit for stapling or the like.

The mark recorder 6 may be any if it records a mark M on the record sheet 2; preferably it also serves as the image formation module, but may be provided as a stamp mechanism, etc., for example, aside from the image formation module. The mark M may be of any shape if it can determine the punch position and can be detected; it may be selected appropriately, for example, as a line or a cross.

The record position of the mark M may also be selected appropriately; however, preferably it is an image nonformation part such as a binding margin of the record sheet 2.

Further, as shown in FIG. 1B, preferably the finishing apparatus 4 further includes mark sensor 7 for detecting the mark M recorded on the record sheet 2. If the mark M recorded on the record sheet 2 is detected by the mark sensor 7, a hole can be punched at the precise punch position.

The mark sensor 7 may be any if it can detect the mark M; for example, a sensor, etc., can be named. Preferably, the punching unit 5 punches a hole in the record sheet 2 as the position of the punching unit 5 is controlled based on the mark M detected by the mark sensor 7.

As a control method of the punching unit 5, for example, control of a computer, etc., can be named in such a manner that the punching unit 5 is moved to a predetermined position for punching based on the mark M detected by the mark sensor 7.

Preferably, the mark sensor 7 is placed in the punching unit 5 as in the example. If the punching unit 5 thus includes the mark sensor 7, mark detection and punching a hole are performed at an extremely near distance, so that variations in punched hole positions can be suppressed.

In such technical means, preferably the record position of the mark M for determining the punch position is in one margin at the center of the record sheet 2 in the width direction thereof and in the proximity of the punch position, for example. If the mark M is thus recorded at the center of the record sheet 2 in the width direction thereof and is detected by the mark sensor 7, a hole can be punched with the width direction center of the record sheet 2 as the reference, so that variations in punched hole positions can be suppressed and high accuracy can be provided.

Further, as another mode of the record position of the mark M, preferably the mark M is recorded at the punch position in the record sheet 2, for example. If the mark M is thus recorded at the punch position, the mark M is also removed at the hole punching time and thus is not left on the record sheet 2, so that the record sheet 2 can be held in good quality.

The finisher 3 may include a finishing unit for predetermined finishing for one margin of the record sheet 2, and the finishing apparatus 4 may further include mark recorder 6 for recording a mark M to determine the finishing position on a record sheet before finishing.

As the finishing, for example, stapling can be named; in the stapling, the finishing is mainly intended for dual stapling, in which case the invention can be applied as with the above-described punching (two holes).

DETAILED DESCRIPTION OF THE PREFERRED EMBODIMENTS

Referring now to the accompanying drawings, there are shown preferred embodiments of the invention.

(First Embodiment)

Figure 1A:
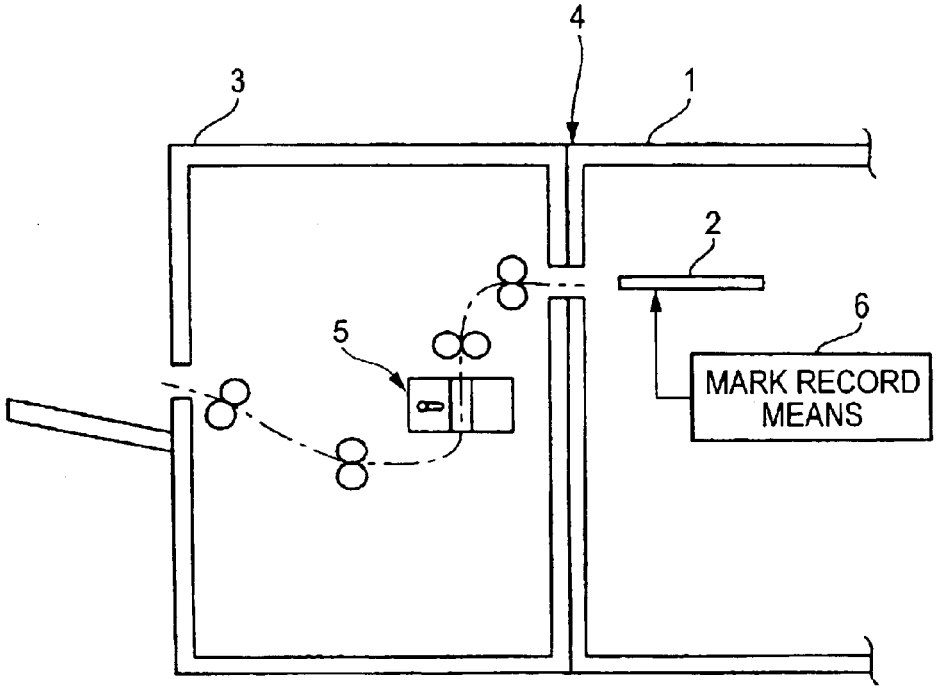
FIGS. 1A and 1B are schematic representations to show an outline of a finishing apparatus according to the invention.
Figure 1B:
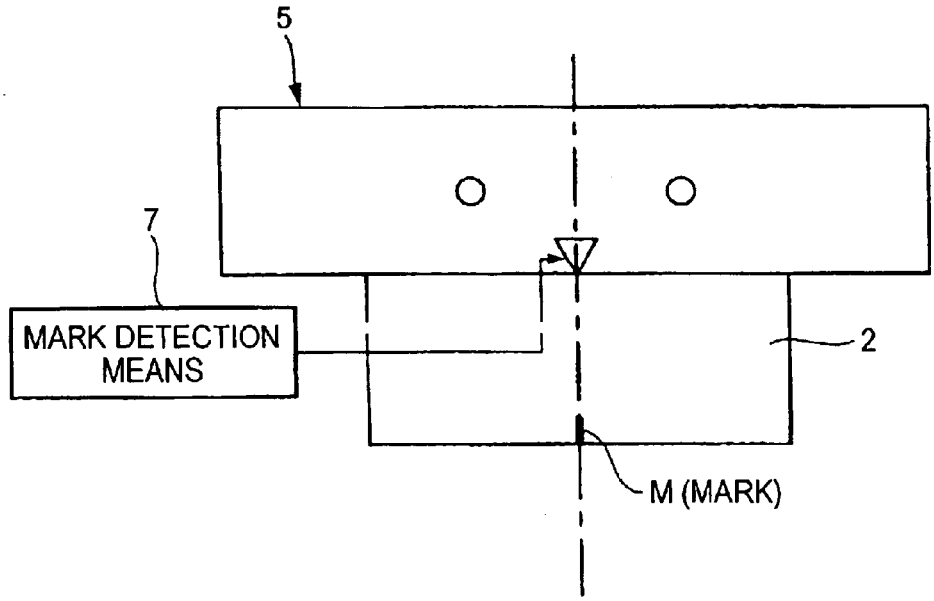
Figure 2:
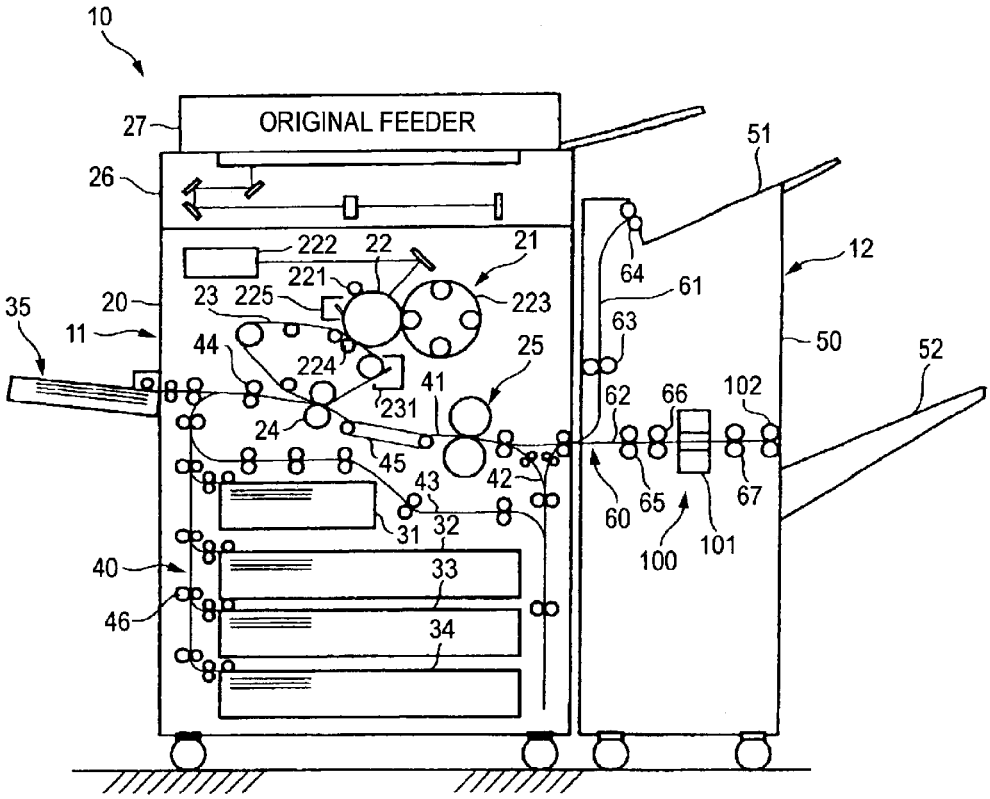
FIG. 2 is a schematic representation to show the general configuration of a finishing apparatus according to a first embodiment of the invention.

FIG. 2 is a schematic representation to show a first embodiment of a finishing apparatus incorporating the invention.

In the figure, a finishing apparatus 10 includes an image forming apparatus 11 capable of forming a color image and a finisher 12 for predetermined finishing for a record sheet S on which an image is formed.

In the embodiment, the image forming apparatus 11 adopts a so-called center registration technique for transporting the record sheet S (not shown) with the width direction center as the reference and forming an image. The image forming apparatus 11 includes an image read unit (IIT: Image Input Terminal) 26 being disposed on the top of a apparatus main unit 20 for reading an original, an original feeder 27 being disposed above the image read unit (IIT) 26 for feeding an original into the image read unit (IIT) 26, an image formation module 21 being disposed in the apparatus main unit 20, sheet supply trays 31 to 34 at multiple stages being disposed below the image formation module 21, and a multi manual tray (MSI: Multi Sheet Inserter) 35 being disposed on a side of the apparatus main unit 20 so that it can be opened and closed.

The image formation module 21 used in the embodiment adopts electrophotography, for example. In the image formation module 21, a photoconductor drum 22 for forming and supporting color component toner images is placed, the color component toner images on the photoconductor drum 22 are primary-transferred to an intermediate transfer belt 23 in order, and the multiple color component toner image provided on the intermediate transfer belt 23 is secondary-transferred to the record sheet S in a secondary transfer unit 24 implemented as a secondary transfer roll, for example, and then the record sheet S is guided into a fuser 25.

The photoconductor drum 22 is surrounded by electrophotographic devices such as a charger 221 for charging the photoconductor drum 22, a light exposure unit 222 of a laser scanner, etc., for writing an electrostatic latent image onto the photoconductor drum 22, a developing unit 223 storing color component toners for visualizing the electrostatic latent image on the photoconductor drum 22, a primary transfer unit 224 implemented as a transfer roll, for example, for transferring the color component toner images on the photoconductor drum 22 to the intermediate transfer belt 23, and a cleaner 225 for cleaning the remaining toner on the photoconductor drum 22.

The intermediate transfer belt 23 is placed on a plurality of placement rolls and is circulated, and the secondary transfer unit 24 is opposed to the intermediate transfer belt 23 with one placement roll as a backup roll. Numeral 231 denotes a cleaner for cleaning the intermediate transfer belt 23.

Further, in the embodiment, a sheet transport passage 40 from the sheet supply trays 31 to 34 includes a main transport passage 41 from the opposite side of the apparatus main unit 20 to the finisher 12 upward through the secondary transfer part and the primary fixing part of the image formation module 21 to the finisher 12, a reversal transport passage 42 being provided roughly like the shape of a letter Y downward in the vicinity of the exit of the main transport passage 41 for reversing the side of the record sheet S and transporting the sheet S, and a return transport passage 43 made to communicate with a part of the reversal transport passage 42 for returning the record sheet with the side reversed to the main transport passage 41 before the image formation module 21.

A registration roll 44 for registering the record sheet S and then transporting the record sheet S is placed upstream from the secondary transfer part in the main transport passage 41 and a transfer belt 45 for transporting the record sheet S to the fuser 25 is placed downstream from the secondary transfer part. An appropriate number of transport rolls are placed on each part of the sheet transport passage 40.

The sheet sending portion from the MS 135 is made to communicate with the horizontal portion of the main transport passage 41.

In the embodiment, the finisher 12 includes an upper ejection tray 51 on the top of a finisher main unit 50 and a lower ejection tray 52 in the vicinity of the side center of the finisher main unit 50 and a transport passage 60 communicating with a sheet ejection port from the apparatus main unit 20. The transport passage 60 includes a first transport passage 61 leading to the upper ejection tray 51 and a second transport passage 62 branching from the first transport passage 61 and leading to the lower ejection tray 52, and a finishing section 100 is placed between the second transport passage 62 and the lower ejection tray 52.

The finishing section 100 includes a finishing unit 101 for finishing of punching, etc., for the record sheet S on which an image is already formed from the image forming apparatus 11, and an ejection roll 102 for ejecting the record sheet S to the lower ejection tray 52 is placed in the downstream exit portion of the finishing unit 101.

Numeral 63 denotes a transport roll, numeral 64 denotes an ejection roll for ejecting the record sheet S to the upper ejection tray 51, numerals 65 and 66 denote transport rolls for transporting the record sheet S from the second transport passage 62 to the finishing section 100, and numeral 67 denotes a transport roll for transporting the record sheet S from the finishing section 100 to the ejection roll 102.

Figure 3:
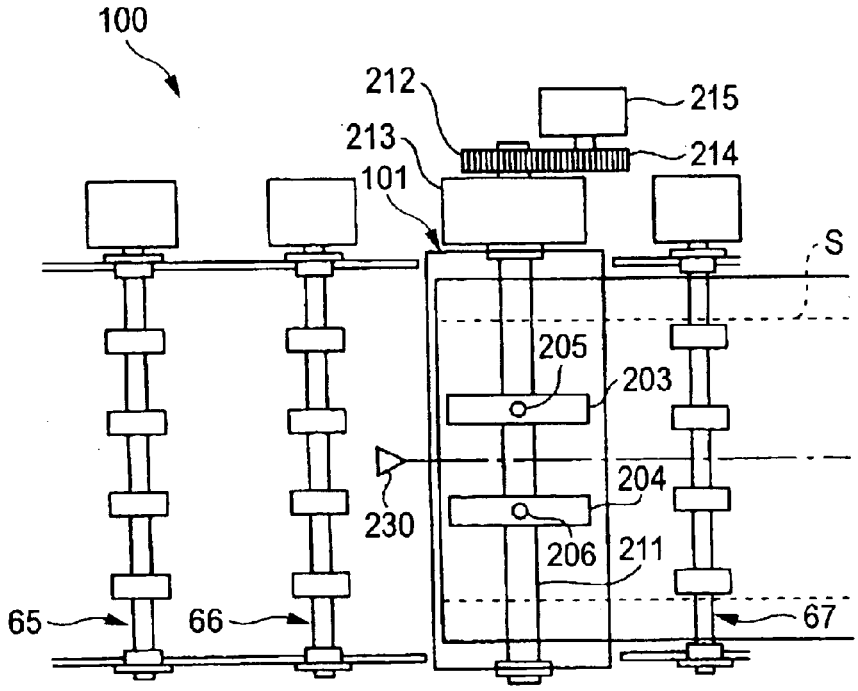
FIG. 3 is a plan view of a finisher used with the finishing apparatus according to the first embodiment of the invention.
Figure 4:
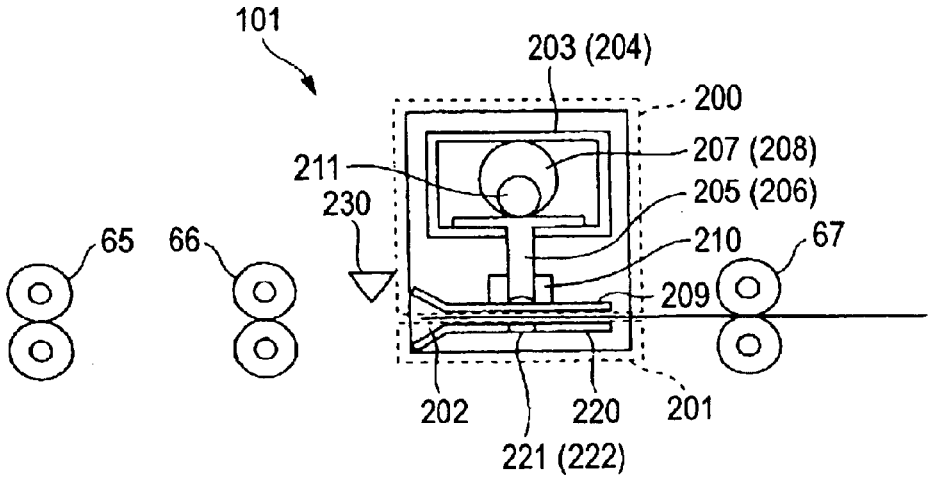
FIG. 4 is a sectional view of the finisher used with the finishing apparatus according to the first embodiment of the invention.

Further, in the embodiment, the finishing unit 101 is a puncher for punching holes in the record sheet S, as shown in FIGS. 3 and 4.

That is, the finishing unit 101 of a puncher consists of a punch section 200 and a die section 201, and a slit-like transport passage 202 through which the record sheet S transported by the transport rolls 65 to 67 passes is formed between the punch section 200 and the die section 201, as shown in FIG. 4.

The punch section 200 is placed with a predetermined spacing corresponding to the punch hole spacing in an orthogonal direction to the transport direction of the record sheet S. The punch section 200 includes punch edges 205 and 206 attached to two frames 203 and 204 each with a side formed like a rectangle, and eccentric cams 207 and 208 are placed in the frames 203 and 204 for rotation.

Further, the transport passage 202 through which the record sheet S passes is defined by a sheet guide 209, and a punch guide 210 for guiding the lower end parts of the punch edges 205 and 206 is fixed to the top of the sheet guide 209. As shown in FIG. 3, a spring clutch 213 on which a gear 212 is disposed is placed in the end part of a cam shaft 211 to which the eccentric cams 207 and 208 are attached, and the drive force of a punch motor 215 is transmitted to the gear 212 of the spring clutch 213 via a drive gear 214.

The spring clutch 213 is turned on/off by a solenoid (not shown).

On the other hand, in the die section 201, the transport passage 202 through which the record sheet S passes is defined by a die section sheet guide 220, and dies 221 and 222 are placed at the positions of the die section sheet guide 220 corresponding to the punch edges 205 and 206, as shown in FIG. 4.

The punch section 200 and the die section 201 are joined to one piece by a joint member at a position wider than the record sheet S of the maximum width direction size running in the finishing unit (puncher) 101.

In the embodiment, in the image forming apparatus 11, a mark M for determining a punch position is recorded on the record sheet S. The mark M is an image non-formation part of the record sheet S and is recorded as a short line in one margin at the center in the width direction, as shown in FIG. 5.

Figure 5:
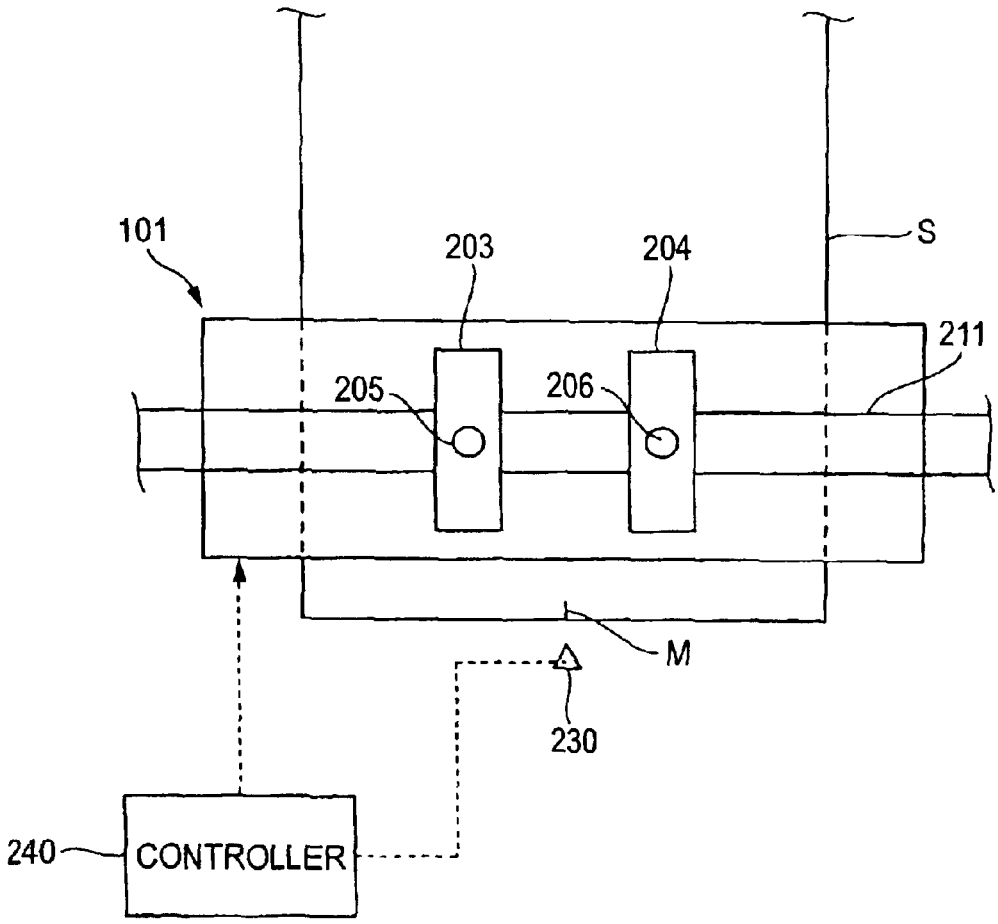
FIG. 5 is a schematic representation to show a mark record position to determine a punch position in the finishing apparatus according to the first embodiment of the invention.

On the other hand, for the finishing unit 101 as the puncher, a mark detection sensor 230 for detecting the mark M is disposed on the transport passage 202 corresponding to the record sheet S entrance side of the sheet guide 209, as shown in FIGS. 3 to 5.

As shown in FIG. 5, the mark detection sensor 230 detects the mark M recorded in the image forming apparatus 11. The finishing unit 101 is moved under the control of a controller 240 based on the detected mark M and punches a hole in the record sheet S at a predetermined position.

Next, the operation of the finishing apparatus according to the embodiment will be discussed centering on the finisher.

Figure 6:
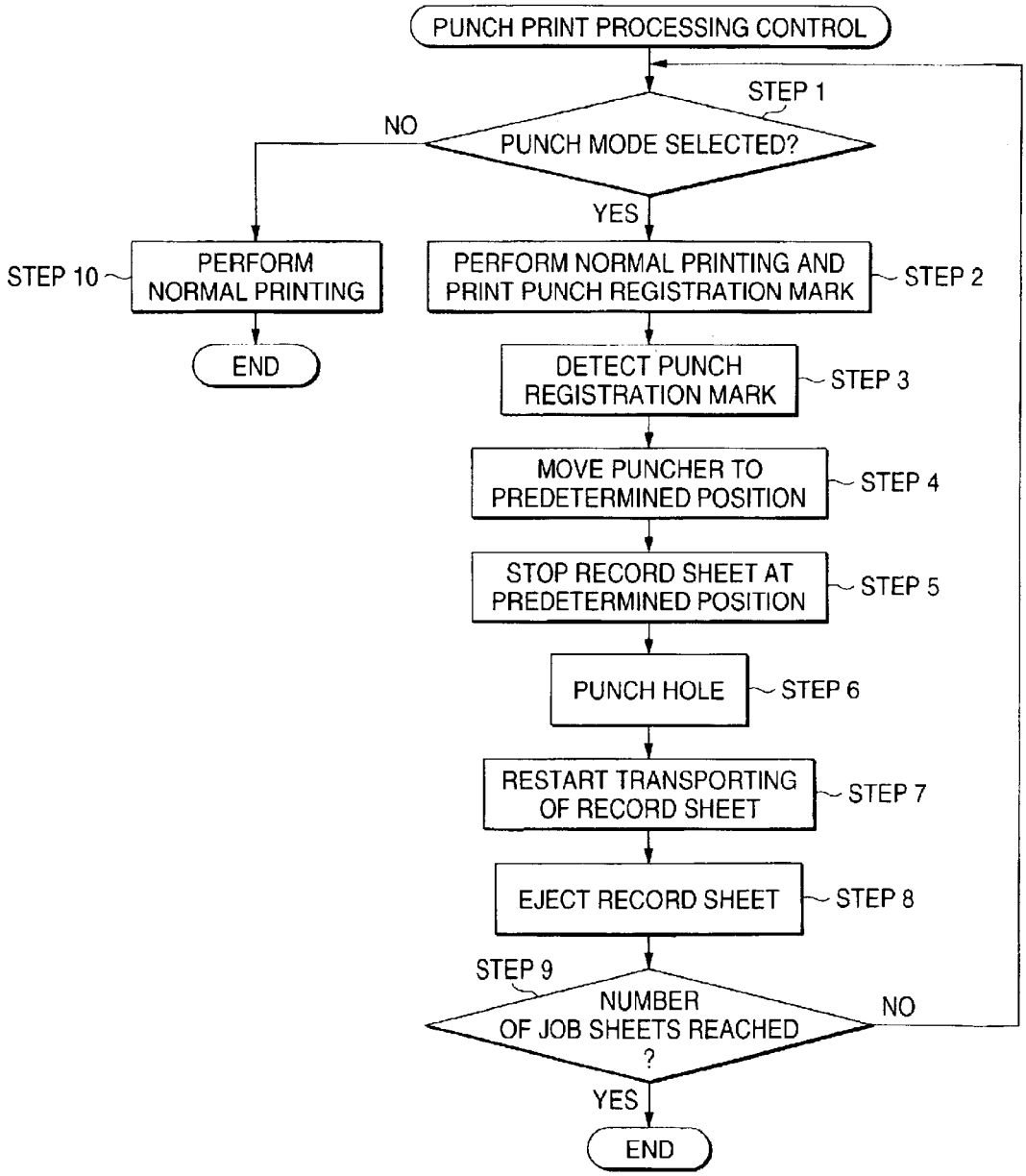
FIG. 6 is a flowchart to show punching of the finishing apparatus according to the first embodiment of the invention.

As shown in FIG. 6, when punch print processing is started, first whether or not a punching mode is selected is determined.

(Step 1)

If the punching mode is not selected, normal printing is performed and the punch print processing is terminated. (Step 10)

On the other hand, if the punching mode is selected, printing is started (Step 2), and further a mark M for determining the punch position is also printed (Step 3).

The mark M is detected by the mark detection sensor 230 (see FIG. 3) and the finishing unit 101 is moved under the control of the controller 240 (see FIG. 5) based on the detected mark M so that the punch edges 205 and 206 are placed at predetermined punch positions (Step 4).

As shown in FIG. 3, when the record sheet S is stopped at a predetermined position by the transport roll 67 (Step 5), the spring clutch 213 is controlled by the solenoid (not shown) and the cam shaft 211 is rotated by drive of the punch motor 215.

Then, together with the cam shaft 211, the eccentric cams 207 and 208 press down the punch edges 205 and 206, which then pierce the record sheet S positioned between the sheet guide 209 and the die section sheet guide 220 and enter the dies 221 and 222 of the die section 201 for punching holes at the predetermined positions of the record sheet S (Step 6).

When the holes are punched, transporting the record sheet S is again started by the transport roll 67 (Step 7), and the record sheet S is ejected to the lower ejection tray 52 by the ejection roll 102, as shown in FIG. 2 (Step 8).

The operation sequence is repeated until the number of job sheets reaches any desired number, and when the desired number of job sheets is reached (Step 9), the operation sequence is terminated.

According to the embodiment, a mark M for determining the punch position is recorded in one margin at the center of the record sheet in the width direction thereof, and the recorded mark M is detected, so that a hole can be punched based on the center of the record sheet in the width direction thereof and variations in punched hole positions can be suppressed and the holes can be punched with high accuracy.

(Second Embedment)

Figure 7:
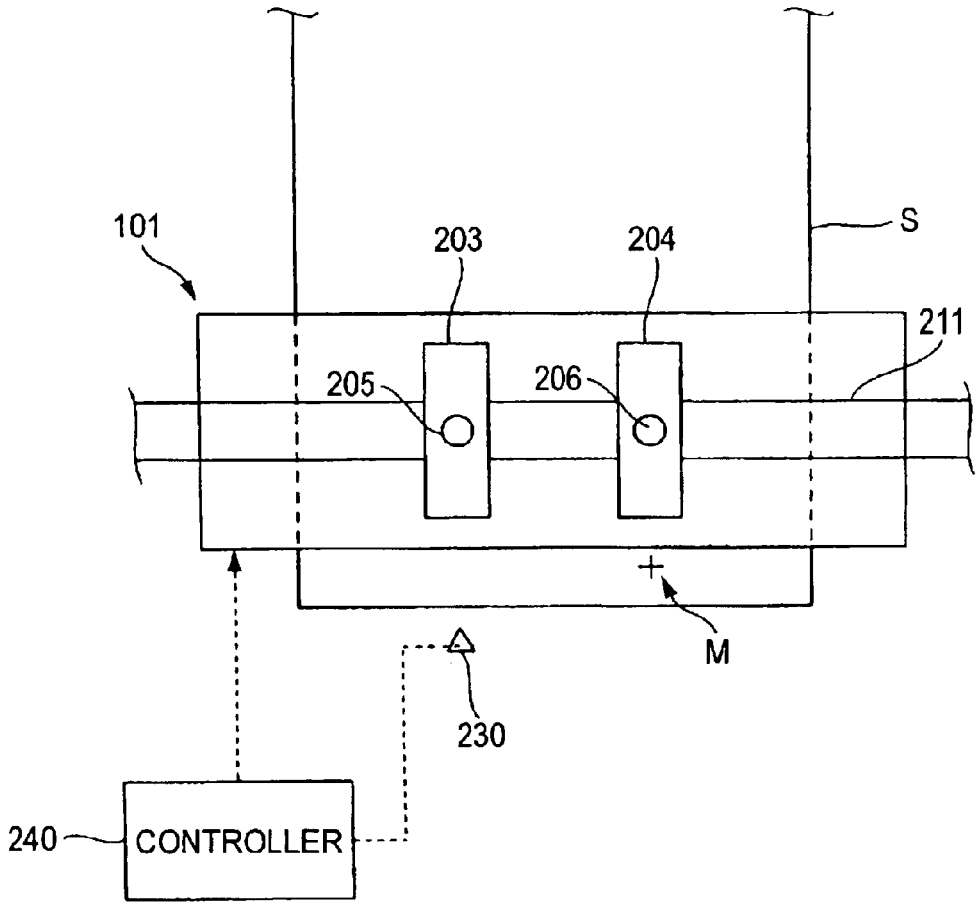
FIG. 7 is a schematic representation to show a mark record position to determine a punch position in a finishing apparatus according to a second embodiment of the invention.
Figure 8A:
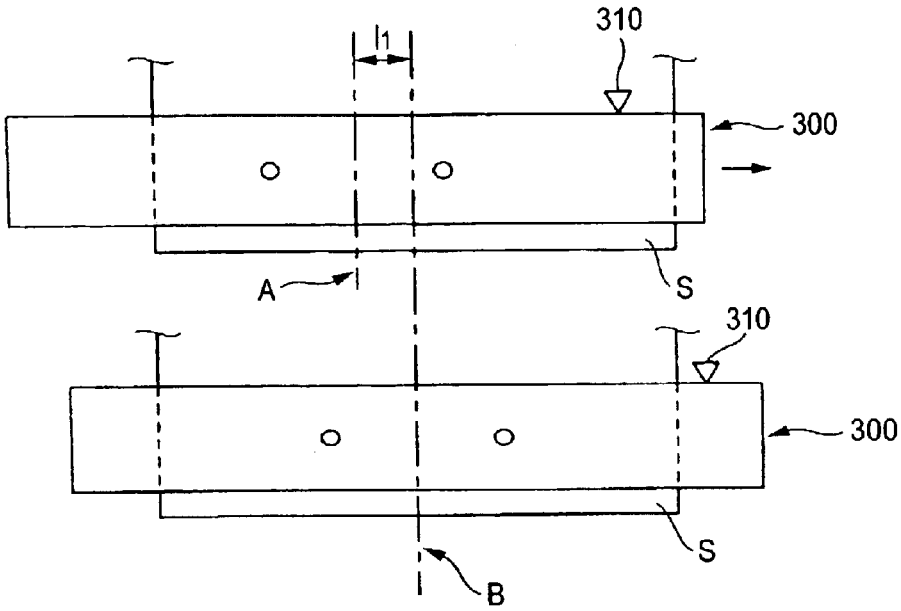
FIGS. 8A and 8B are schematic representations to show the relationship between a sheet size and the move distance of a puncher in a finishing apparatus in a related art.
Figure 8B:
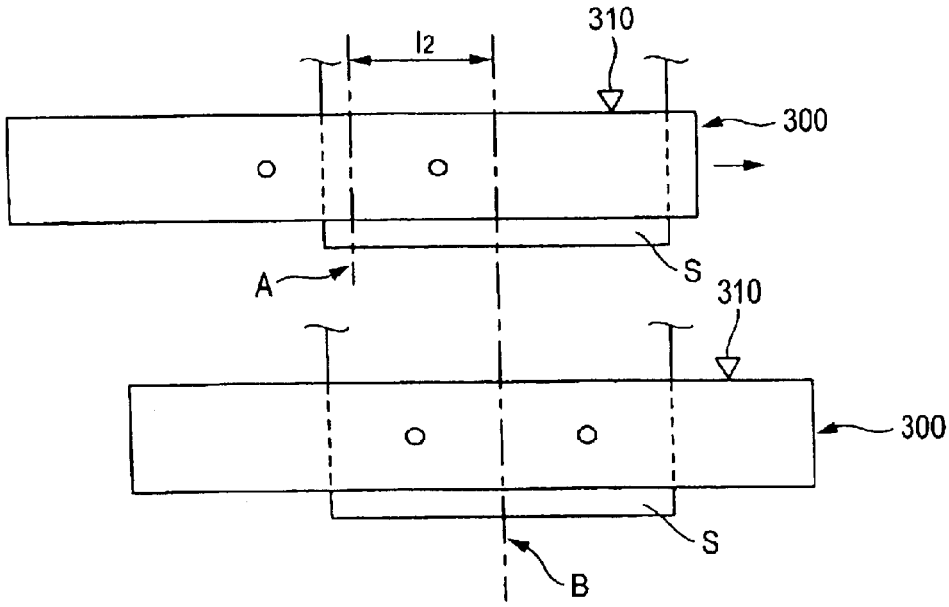

FIG. 7 is a schematic representation to show a mark record position for determining a punch position in a second embodiment of a finishing apparatus incorporating the invention. In the figure, the finishing apparatus according to the second embodiment has a basic configuration roughly similar to that of the finishing apparatus according to the first embodiment; the second embodiment differs from the first embodiment in that a mark M for determining a punch position is recorded at the punch position.

That is, as shown in FIG. 7, the mark M recorded in an image forming apparatus 11 is the shape of a cross recorded with the punch hole center as the reference; in the embodiment, two holes are to be punched and therefore the mark M is recorded at either of two punch positions.

A mark detection sensor 230 detects the mark M and a controller 240 controls a finishing unit 101 so as to punch holes at predetermined positions of a record sheet S.

Components similar to those previously described with reference to FIG. 5 in the first embodiment are denoted by the same reference numerals in FIG. 7 and will not be again discussed in detail.

The second embodiment also provides roughly similar advantages to those of the first embodiment. In addition, according to the second embodiment, the mark M is recorded at the punch position and thus the mark M is also removed at the hole punching time and is not left on the record sheet S, so that the quality of the record sheet S can be held good.

(Third Embodiment)

A finishing apparatus according to a third embodiment of the invention has a basic configuration roughly similar to that of the finishing apparatus according to the first embodiment; the third embodiment differs from the first embodiment in that the finishing unit 101 shown in FIG. 2 is a stapler for stapling a record sheet S and in particular intended for dual staple.

Since the third embodiment is intended for dual staple, as the record position of a mark M for determining a staple position, a similar configuration to that in the second embodiment may be adopted.

The third embodiment also provides roughly similar advantages to those of the first or second embodiment.

As described above, according to the invention, the finishing apparatus includes the mark recorder for recording a mark to determine the punch position on a record sheet before punching, so that the punch position can be determined simply by detecting the mark and it is made possible for one mark sensor to deal with various records sheets different in sheet size.

In the invention, if the finishing apparatus includes the mark sensor for detecting a mark recorded on a record sheet and a hole is punched in the record sheet as the position of the punching unit is controlled based on the mark detected by the mark sensor, the need for reciprocating the punching unit for each sheet size of record sheets is eliminated and compatibility with a high-speed machine and high productivity can be realized.

Further, the invention is mainly effective for punching, but can also be applied to any finishing other than punching.

Besides, the finishing apparatus has punch position specification unit for specifying a position where the punching apparatus punches a hole. The punch position specification unit may specify the position where the punching apparatus punches a hole based on the distance from an edge of the record sheet or may select a punch position from among punch positions.

Then, there is a finisher characterized in that a finishing unit includes the mark sensor.

Further, there is a finishing apparatus includes an image forming apparatus for forming an image by an image formation module, a punching apparatus for punching a hole in a record sheet on which an image is already formed from the image forming apparatus, and punch position specification unit for specifying a position where the punching apparatus punches a hole.

Still further, there is a finishing apparatus, characterized in that the punch position specification unit specifies the position where the punching apparatus punches a hole based on a distance from an edge of the record sheet.

What is claimed is:

1. A finisher comprising:

a mark sensor for detecting a mark recorded on a record sheet and for recognizing a center position of a width of the record sheet with detecting the width of the record sheet, and a finishing unit for finishing for the record sheet, wherein a finishing position is determined based on the position of the mark detected by said mark sensor.

2. The finisher as in claim 1, wherein said finishing unit comprises said mark sensor.

3. A finishing apparatus comprising:

an image forming apparatus for forming an image by an image formation module, a finisher for finishing for a record sheet on which an image is already formed from said image forming apparatus, and a mark recorder for recording a mark to recognize a center position of width of the record sheet with detecting the width of the record sheet, the mark to determine the finishing position on the record sheet before said finisher finishes.

4. The finishing apparatus as in claim 3, further comprising:

mark sensor for detecting the mark recorded on the record sheet.

5. The finishing apparatus as in claim 3, wherein said finisher includes a finishing unit for finishing on the record sheet, said finishing unit finishing for the record sheet as said position of said finishing unit is controlled based on the mark detected by mark sensor.

6. The finishing apparatus as in claim 3, wherein said finishing unit comprises said mark sensor.

7. The finishing apparatus as in claim 5, wherein said finisher punches a hole in the record sheet.

8. The finishing apparatus as in claim 7, wherein said mark recorder records the mark in one margin at the center of the record sheet in the width direction thereof and in the proximity of a punch position.

9. The finishing apparatus as in claim 7, wherein said mark recorder records the mark at a punch position in the record sheet.

10. The finishing apparatus as in claim 3, wherein said finisher staples the record sheet.

11. An image forming apparatus comprising:

an image formation module for forming an image, a transporter for transporting a record sheet with an image formed by said image formation module to a finisher for finishing for the record sheet, and a mark recorder for recording a mark to recognize a center position of width of the record sheet with detecting the width of the record sheet, the mark to determine the finishing position on the record sheet before said transporter transports the record sheet to said finisher.

12. A finishing apparatus comprising:

an image forming apparatus for forming an image by an image formation module, a punching apparatus for punching a hole in a record sheet on which an image is already formed from said image forming apparatus, and a punch position specification unit for specifying a position where said punching apparatus punches a hole, said punch position specification unit including a mark sensor to recognize a center position of a width of the record sheet with detecting the width of the record sheet.

13. The finishing apparatus as in claim 12, wherein said punch position specification unit specifies the position where said punching apparatus punches a hole based on a mark recorded on the record sheet.

14. The finishing apparatus as in claim 12, wherein said punch position specification unit includes punch position selector for selecting a punch position from among punch positions.

* * * * *